US006439499B2

(12) United States Patent
Lassmann

(10) Patent No.: US 6,439,499 B2
(45) Date of Patent: Aug. 27, 2002

(54) METHOD AND APPARATUS FOR WINDING CROSS-WOUND BOBBINS DRIVEN IN A ROTARY MANNER

(75) Inventor: Manfred Lassmann, Nettetal (DE)

(73) Assignee: W. Schlafhorst AG & Co. (DE)

( * ) Notice: Subject to any disclaimer, the term of this patent is extended or adjusted under 35 U.S.C. 154(b) by 24 days.

(21) Appl. No.: 09/791,197

(22) Filed: Feb. 23, 2001

(30) Foreign Application Priority Data

Feb. 25, 2000 (DE) ..... 100 09 085
Oct. 20, 2000 (DE) ..... 100 51 997

(51) Int. Cl.[7] ..... B65H 65/00; B65H 57/00; B65H 69/00

(52) U.S. Cl. ..... 242/476.4; 242/157 R; 242/475.4

(58) Field of Search ..... 242/475.7, 476.3, 242/476.4, 157 R, 475.1, 475.4

(56) References Cited

U.S. PATENT DOCUMENTS

| | | | | | |
|---|---|---|---|---|---|
| 3,907,217 | A | * | 9/1975 | Graf et al. | 242/476.4 |
| 3,955,768 | A | * | 5/1976 | Fluck et al. | 242/476.4 |
| 4,002,306 | A | | 1/1977 | Raasch | 242/476.7 |
| 4,049,209 | A | * | 9/1977 | Bach et al. | 242/476.4 |
| 4,474,337 | A | * | 10/1984 | Schiminski et al. | 242/476.4 |
| 5,016,829 | A | * | 5/1991 | Schippers et al. | 242/476.4 X |
| 5,104,051 | A | * | 4/1992 | Berg et al. | 242/476.4 |
| 5,159,804 | A | * | 11/1992 | Schippers et al. | 57/261 |
| 5,284,010 | A | * | 2/1994 | Dammann | 242/476.4 X |
| 5,348,242 | A | * | 9/1994 | Bauer et al. | 242/475.7 X |
| 5,810,270 | A | * | 9/1998 | Backer et al. | 242/476.4 X |

FOREIGN PATENT DOCUMENTS

| | | | | |
|---|---|---|---|---|
| DE | AS 1 760 243 | | 8/1972 | |
| DE | 74 37 800 | | 3/1975 | |
| DE | 23 53 202 | A1 | 5/1975 | |
| DE | 24 54 916 | C2 | 10/1983 | |
| DE | 23 28 828 | C2 | 8/1984 | |
| DE | 36 16 753 | A1 * | 1/1987 | 242/476.4 |
| DE | 39 30 136 | A1 | 3/1991 | |
| DE | 39 22 719 | C2 | 2/1993 | |

OTHER PUBLICATIONS

German Search Report.

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

A traversing yarn guide (5) that is moved back and forth produces cross winding of yarn on a bobbin at each winding head of a textile spinning or winding machine in order to wind cross-wound bobbins. After a yarn interruption, an auxiliary yarn guide (4) in an active position keeps the yarn in a position that is raised out of the traversing yarn guide (5). In a rest position (40'), the auxiliary yarn guide (4) does not influence the yarn and the traversing yarn guide (5) can grasp and take the yarn to be wound from the auxiliary yarn guide (4). In order to assure a reliable insertion of the yarn (3) into the traversing yarn guide (5) and to assure its correct grasping of the yarn (3), the yarn (3) assumes an initial position within the traversing range after the yarn interruption, which position is set by the auxiliary yarn guide (4) in the active position, before the yarn (3) is lowered into the stationary traversing yarn guide (5) by a position change of the auxiliary yarn guide (4) into the rest position (4').

9 Claims, 2 Drawing Sheets

METHOD AND APPARATUS FOR WINDING CROSS-WOUND BOBBINS DRIVEN IN A ROTARY MANNER

CROSS-REFERENCES TO RELATED APPLICATIONS

This application claims the benefit of German patent applications 10009085.0 filed Feb. 25, 2000, and 10051997.0 filed Oct. 20, 2000, herein incorporated by reference.

BACKGROUND OF THE INVENTION

The present invention relates to a method and apparatus for the cross-winding of a yarn onto a rotationally driven tube to form a yarn bobbin.

German Patent Publications DE-GM 74 37 800 [utility model] and DE 23 28 828 C2disclose the formation of a yarn reserve on winding bobbins with the aid of a traversing auxiliary yarn guide. The auxiliary yarn guide is pivotable to lift the yarn during an upward pivoting motion out of the yarn guide executing a traversing motion in order to form the desired reserve windings or waste windings on the bobbin tube outside of the traversing range of the yarn guide. A reverse pivoting of the auxiliary yarn guide brings the yarn back into the grasping range of the yarn guide where the yarn is grasped again by the yarn guide upon its traversing motion and is wound further into a cross-wound bobbin.

Such devices are suitable only in a very limited manner or not at all suitable for the problem of transferring the yarn to the yarn guide of the winding head after a yarn interruption and after a subsequent reestablishing of the yarn connection at the work station of a textile machine. In such case, the transfer of the yarn does not take place in coordination with the motion of the yarn guide and, thus, the yarn can be held for a while at one and the same location of the bobbin and can be deposited in a fairly great number of superimposed windings. The superimposed localized yarn windings that result thereby can cause problems during the unwinding of the yarn from the cross-wound bobbins.

German Patent Publication DE 39 30 136 A1 teaches coordinating the motion of the yarn to be transferred and the traversing motion of the yarn guide with one another in such a manner that the transfer of the yarn and the yarn guide arrive essentially simultaneously at the transfer point to the yarn guide and execute the yarn transfer while the yarn guide is in the traversing motion. Although considerable expense is necessary for the construction and regulating technology needed for this transfer, an exact coincidence in time of the arrival of the yarn and of the yarn guide at the transfer point is still not necessarily assured with this device.

In the winding of conical cross-wound bobbins disclosed in German Patent Publication DE 24 54 916 C2, the yarn to be wound onto the tube after a bobbin change or after a yarn break is first held by an auxiliary yarn guide and then taken over after being released by the yarn guide when the latter is moving in the direction of travel toward the smaller bobbin diameter. The raising and lowering of the auxiliary yarn guide takes place by means of a relatively complicated actuating mechanism comprising several pivot levers. The curved yoke-shaped auxiliary yarn guide and actuating mechanism are designed in such a manner that they take up a relatively large amount of space, in particular in the vertical direction, and thus can cause problems on the front side of the winding head, which significantly limits the possibilities of using this system.

The methods and devices disclosed in German Patent Publications DE 24 54 916 C2, DE 39 30 136 A1, DE 23 28 828 C2 and DE-GM 74 37 800 share the significant disadvantage that the traversing yarn guide takes over the yarn to be wound onto the bobbin after it has been released from the auxiliary yarn guide during its back-and-forth traversing motion. This manner of operation entails the danger that the yarn will not be threaded as intended into the yarn guide and will not be entrained in a properly threaded state but rather may be grasped at a position of the yarn guide that is not intended for receiving the yarn and therefore may instead be pushed in front of the yarn guide over the lateral edge of the cross-wound bobbin. This can cause yam breaks and even windings off the bobbin tube onto the supporting tube plate of the winding station which windings can only be removed by a time-consuming intervention by operating personnel. The problem can not be solved even by relatively expensive monitoring and control measures for the yarn guide and the yarn transfer device like those described, e.g., in German Patent Publication DE 39 30 136 A1. Rather, the yarn and yarn guide are merely allowed to arrive essentially at the same time at the transfer point or care is taken that the yarn arrives at least slightly before the yarn guide and in no case after the yarn guide. The danger of the above-cited disadvantages due to an undesired shifting of the yarn over the bobbin edge is present precisely upon an arrival of the yarn in front of the yarn guide or when it is being held ready for the yarn guide executing the traversing motion.

SUMMARY OF THE INVENTION

It is therefore an object of the present invention to address these problems with an improvement of the known winding methods and apparatus for transferring a yarn to a traversing yarn guide.

The invention addresses this problem by an improved method and apparatus for cross-winding of bobbins in a textile machine, such as a spinning or winding machine, of the general type comprising a plurality of winding heads each have a traversing yarn guide movable back and forth relative to a bobbin for cross winding of a yarn onto the bobbin and an auxiliary yarn guide movable between an active position for holding the yarn in a raised position out of the traversing yarn guide and an inactive resting position wherein the yarn is positioned to be taken by the traversing yarn guide to be wound onto the bobbin. According to the present invention, after a yarn interruption, such as a yarn breakage, the back and forth movement of the traversing yarn guide is stopped and the interrupted yarn is reconnected, the reconnected yarn is guided by the auxiliary yarn guide into an initial position relative to the traversing path of the traversing yarn guide wherein the auxiliary yarn guide is in the active position, and the yarn is then lowered into the traversing yarn guide by moving the auxiliary yarn guide from the active position into the inactive resting position before the traversing yarn guide is restarted. In the present apparatus, a control device is provided to control actuation of this sequence of steps.

In this manner, a reliable threading of the yarn during its takeover by the traversing yarn guide is achieved in a simple manner and with relatively low expense by the present invention and advantageously avoids an undesired pushing of the yarn in front of the yarn guide beyond the bobbin edge.

The lowering and the take-up of the yarn preferably take place after the drive of the cross-wound bobbin has started and a brief time delay has elapsed after the beginning of the rotation of the cross-wound bobbin. Alternatively, the lowering and the take-up of the yarn can advantageously take place after a set number of revolutions of a friction roller driving the cross-wound bobbin has been achieved. The number of yarn windings wound on the bobbin during the standstill of the traversing yarn guide can thereby be kept extremely small. Localized bands of yarn windings that could result in problems during the unwinding of the cross-wound bobbins are avoided.

The auxiliary yarn guide can preferably pivot between the active position and the rest position. This can reduce the space requirement to a minimum in that the pivot shaft of the auxiliary yarn guide can be located at a very small interval from the traversing yarn guide whereas on the other hand, for example, any type of simple crank system suffices to pivot the auxiliary yarn guide. In particular, the auxiliary yarn guide can be attached to a shaft that can pivot back and forth by means of a pneumatic cylinder which is pivotably mounted to operate the shaft via a pivot lever. The pivoting motion is initiated by the afore-mentioned control device.

In an advantageous embodiment of the device in accordance with the present invention, the mass to be moved can be kept very small and the change from the active position into the rest position of the auxiliary yarn guide can be carried out extremely rapidly. As a consequence, the time required for aligning the yarn in the start position and for the lowering and the take-up of the yarn by the traversing yarn guide can be kept extremely short. In such an extremely short time only a few windings, e.g., 1 to 3 windings, are deposited, so that no localized yarn bands are produced by the winding of the yarn on an unchanging location on the cross-wound bobbin that might cause problems during unwinding.

It is advantageous if the auxiliary yarn guide can pivot in the direction of the traversing yarn guide into its rest position. In addition to an extremely small space requirement and practically no hindrance at the winding head, only a very small pivot angle must be overcome for such a pivoting motion. Moreover, the pivoting motion is supported by the yarn tension. As a consequence, the time delay before restarting of the traversing of the yarn can be held advantageously short.

Preferably, in embodiments in machines and methods for the winding of conical bobbins, the control device is designed such that the traversing yarn guide initially moves after the yarn interruption toward the bobbin end of the greater diameter, whereby the yarn is maintained tautened thereby preventing the yarn from being able to pull itself back out of the traversing yarn guide.

The invention makes possible in a simple manner a reliable take-up of the yarn by the traversing yarn guide after a yarn interruption without disadvantageous winding bands having to occur as in the prior devices described above.

The invention is described in greater detail in the following specification with reference made to the accompanying drawing figures.

DETAILED DESCRIPTION OF THE PREFERRED EMBODIMENT

Figure 2:
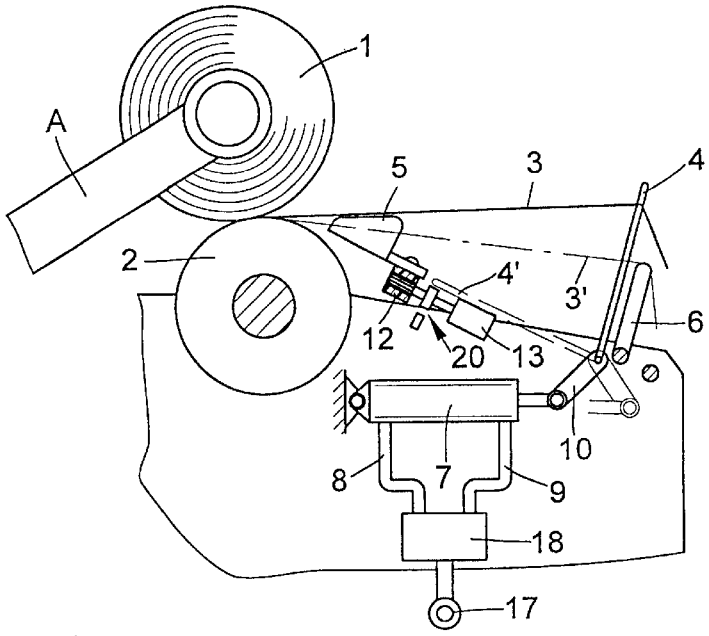
FIG. 2 is a lateral side elevational view of the device of FIG. 1.
Figure 1:
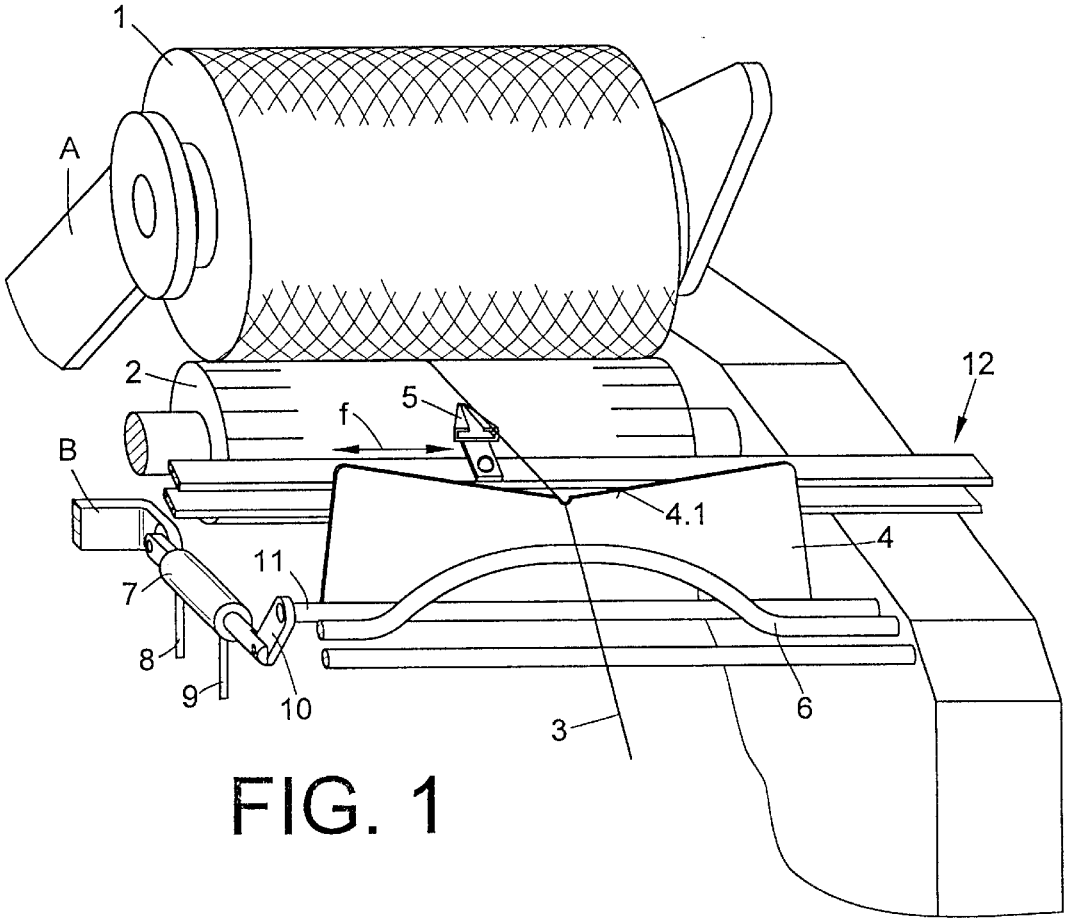
FIG. 1 is a simplified schematic perspective view of a winding head in accordance with the present invention.
Figure 3:
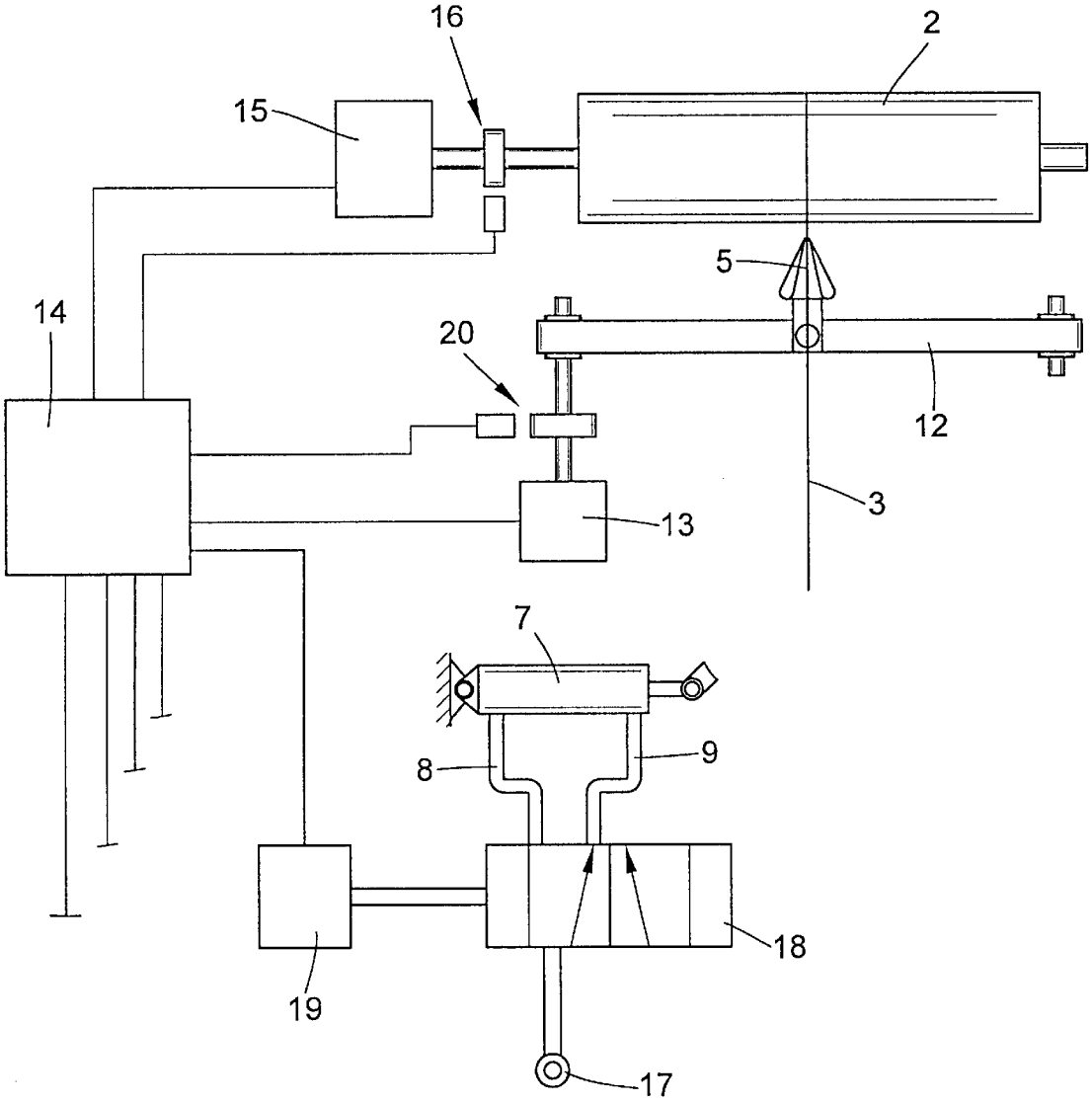
FIG. 3 is a simplified schematic block diagram depicting a portion of the device in accordance with the present invention.

Referring now to the accompanying drawings and initially to FIGS. 1 and 2, a cross-wound bobbin 1 is mounted in customary manner in a pivotable creel A which holds the bobbin 1 in surface contact with a friction drive roller 2 for driving rotation of the bobbin for winding thereon of yarn 3. Instead of friction drive roller 2, cross-wound bobbin 1 can also be rotatably driven by an individual motor drive (not shown) in which instance cross-wound bobbin 1 is then supported in known manner on a support roller. During the orderly winding of the yarn on the bobbin, the yarn 3 is driven in a back-and-forth motion by traversing yarn guide 5 driven in the direction of double arrow f. Traversing yarn guide 5 is moved by motor 13 via toothed belt 12 driven in a back and forth motion. Motor 13, and therewith the traversing motion and positioning of traversing yarn guide 5, are monitored by a motion pickup sensor 20 shown in FIG. 3 and by control device 14 connected thereto.

In the view of FIGS. 1 and 2, auxiliary yarn guide 4 is in an active position in which it has grasped yarn 3. As a result, yarn 3 is raised out of traversing yarn guide 5. In this position, yarn 3 is also raised in such a manner relative to its winding position that it no longer touches yarn guide bracket 6, which acts as a yarn support bracket, shown in the exemplary embodiment of FIGS. 1 and 2. A pneumatic cylinder 7 is articulated to machine frame B, only schematically indicated, and is loaded via lines 8 and 9 alternatively with compressed air from compressed air source 17 so as to serve to pivot auxiliary yarn guide 4 between rest position 4' and the active position. The loading of line 8 or 9 with compressed air takes place with the aid of valve 18 and relay 19 that is actuated by control device 14. Pneumatic cylinder 7 drives pivot 10 lever 10 that serves to pivot shaft 11 which is permanently connected to auxiliary yarn guide 4. Auxiliary yarn guide 4 comprises upper yarn guide edge 4.1 extending over the traversing range of traversing yarn guide 5, which edge 4.1 has a contour falling from both sides to the middle of the traversing stroke of traversing yarn guide 5, that is, yarn guide edge 4.1 is lowered toward the middle. Auxiliary yarn guide 4 is pivoted into the active position upon a yarn interruption such as, e.g., a yarn break.

Once the yarn connection between the yarn supply source and cross-wound bobbin 1 has been reestablished after the yarn interruption, friction drive roller 2 is started by motor 15. A brief time period also begins with the start of the rotary motion of friction drive roller 2. The rotary motion of friction drive roller 2 results in a tautening of yarn 3. Thereupon at the latest, yarn 3 is guided by yarn guide edge 4.1 of auxiliary yarn guide 4 into its lowered middle position that is the initial position of auxiliary yarn guide 4. In this initial position, yarn 3 is located precisely above traversing yarn guide 5 located in a corresponding middle position shown in FIG. 1 defined as a yarn transfer position.

The lowering of yarn 3 takes place after yarn 3 has tautened. The lowering can be brought about by control device 14 after time period 5 has elapsed, which is determined to be sufficiently long to assure a tautening of the yarn, or, alternatively, after a given number of revolutions of friction drive roller 2. The number of revolutions as well as the angular position of friction drive roller are detected by motion pickup sensor 16 and evaluated by control device 14. A further alternative possibility, not shown for reasons of simplicity, is to measure the yarn tension as it increases, e.g., with a customary yarn tension sensor, and to initiate the lowering of yarn 3 after the yarn tension measured and evaluated by control device 14 has achieved a predetermined value.

Auxiliary yarn guide 4, preferably designed as shown as a yarn guide sheet or plate, is pivoted down into rest position 4', shown in dotted lines in FIG. 1, by loading pneumatic cylinder 7 with compressed air via line 8, as a result of which yarn 3 is lowered until it rests, on the one hand, on yarn guide bracket 6 and, on the other hand, has been placed in resting traversing yarn guide 5 and thereby assumed position 3' shown in FIG. 1.

After the placing of yarn 3 into traversing yarn guide 5 the traversing motion of traversing yarn guide 5 is started by control device 14 and coordinated with the rotary motion of cross-wound bobbin 1. The winding process can now be continued in the customary manner.

The invention is not limited to the exemplary embodiment shown. For example, auxiliary yarn guide 4 can be designed alternatively as a wire bracket Control device 14 can be connected via lines (not designated in more detail) to other elements of the work station, of the textile machine or to other control devices, e.g., computers.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a method for winding rotationally driven cross-wound bobbins in a textile machine comprising a plurality of winding heads each having a traversing yarn guide movable back and forth relative to a bobbin for cross winding of a yarn onto the bobbin and an auxiliary yarn guide movable between an active position for holding the yarn in a raised position out of the traversing yarn guide and an inactive resting position wherein the yarn is positioned to be taken by the traversing yarn guide to be wound onto the bobbin, the improvement comprising the steps of stopping the back and forth movement of the traversing yarn guide after a yarn interruption, reconnecting the interrupted yarn, guiding the reconnected yarn by the auxiliary yarn guide into an initial position relative to the traversing path of the traversing yarn guide wherein the auxiliary yarn guide is in the active position, and then lowering the yarn into the traversing yarn guide by moving the auxiliary yarn guide from the active position into the inactive resting position before the traversing yarn guide is restarted.

2. The method according to claim 1, further comprising stopping the rotational driving of the bobbin after the yarn interruption and restarting the rotational driving of the bobbin after the reconnecting of the yarn and before the lowering of the yarn into the traversing yarn guide by the auxiliary yarn guide.

3. The method according to claim 2, further comprising delaying the lowering of the yarn into the traversing yarn guide by the auxiliary yarn guide a predetermined time after the restarting of the rotational driving of the bobbin.

4. The method according to claim 2, further comprising delaying the lowering of the yarn into the traversing yarn guide by the auxiliary yarn guide until a friction roller driving the bobbin has executed a predetermined number of revolutions after the restarting of the rotational driving of the bobbin.

5. In a textile machine for winding rotationally driven cross-wound bobbins comprising a plurality of winding heads each having a traversing yarn guide movable back and forth relative to a bobbin for cross winding of a yarn onto the bobbin and an auxiliary yarn guide movable between an active position for holding the yarn in a raised position out of the traversing yarn guide and an inactive resting position wherein the yarn is positioned to be taken by the traversing yarn guide to be wound onto the bobbin, the improvement comprising a control device associated with each winding head for stopping the back and forth movement of the traversing yarn guide after a yarn interruption, for actuating a reconnecting of the interrupted yarn, and for actuating the auxiliary yarn guide initially into the active position for guiding the reconnected yarn into an initial position relative to the traversing path of the traversing yarn guide and then moving the auxiliary yarn guide from the active position into the inactive resting position before the traversing yarn guide is restarted for lowering the yarn into the traversing yarn guide.

6. The device according to claim 5, further comprising a separate drive for the traversing yarn guide and wherein the auxiliary yarn guide has a yarn guide edge shaped for moving the yarn, during movement of the auxiliary yarn guide from the active position into the rest position, into a position of the yarn to be inserted into the traversing yarn guide when in stopped position.

7. The device according to claim 5, wherein a yarn guide edge of the auxiliary yarn guide extends over a traversing range of the traversing yarn guide, has a contour sloping downwardly from opposite ends of the yarn guide edge toward a middle of the yarn guide edge, and is pivotable under the control of the control device between the active position and the rest position.

8. The device according to claim 5, wherein the auxiliary yarn guide is pivotable into the rest position in a direction of the traversing yarn guide.

9. The device according to claim 5, wherein the auxiliary yarn guide is permanently attached to a shaft and is pivotable by a pneumatic cylinder attached to the shaft via a pivot lever.

* * * * *